US010460686B2

(12) United States Patent
Kwak et al.

(10) Patent No.: US 10,460,686 B2
(45) Date of Patent: Oct. 29, 2019

(54) GATE DRIVING DEVICE, DISPLAY DEVICE INCLUDING THE SAME, AND METHOD FOR DRIVING THE DISPLAY DEVICE FOR REDUCING KICKBACK VOLTAGE

(71) Applicant: SAMSUNG DISPLAY CO., LTD., Yongin-si, Gyeonggi-Do (KR)

(72) Inventors: Tong Ill Kwak, Yongin-si (KR); Kl Hyun Pyun, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 647 days.

(21) Appl. No.: 15/097,911

(22) Filed: Apr. 13, 2016

(65) Prior Publication Data

US 2016/0343341 A1 Nov. 24, 2016

(30) Foreign Application Priority Data

May 22, 2015 (KR) ..... 10-2015-0072134

(51) Int. Cl.
*G09G 3/36* (2006.01)

(52) U.S. Cl.
CPC ... *G09G 3/3677* (2013.01); *G09G 2320/0214* (2013.01)

(58) Field of Classification Search
None
See application file for complete search history.

(56) References Cited

U.S. PATENT DOCUMENTS

2008/0170064 A1* 7/2008 Lee ..... G09G 3/3677 345/214
2009/0085927 A1 4/2009 Jung
2010/0156928 A1* 6/2010 Lee ..... G09G 3/2096 345/589
2014/0111413 A1 4/2014 Chen et al.
2014/0333592 A1 11/2014 Cho et al.
2014/0347258 A1* 11/2014 Hwang ..... G09G 3/3677 345/87
2016/0005365 A1* 1/2016 Choi ..... G09G 3/2007 345/690

FOREIGN PATENT DOCUMENTS

KR 1020030064999 8/2003
KR 10-2009-0032931 4/2009
KR 10-2013-0131332 12/2013
KR 1020140055525 5/2014
KR 10-2014-0134135 11/2014

* cited by examiner

*Primary Examiner* — William Boddie
*Assistant Examiner* — Alecia D English
(74) *Attorney, Agent, or Firm* — F. Chau & Associates, LLC

(57) ABSTRACT

Embodiments relate to a gate driving device including a reference voltage generator for generating a kickback compensating reference voltage, the kickback compensating reference voltage decreasing during one frame section based on a horizontal synchronization signal, and a gate output voltage generator for decreasing a kickback compensating voltage of a gate output voltage during one frame section based on the kickback compensating reference voltage.

16 Claims, 8 Drawing Sheets

GATE DRIVING DEVICE, DISPLAY DEVICE INCLUDING THE SAME, AND METHOD FOR DRIVING THE DISPLAY DEVICE FOR REDUCING KICKBACK VOLTAGE

CROSS-REFERENCE TO RELATED APPLICATION

This application claims priority to and the benefit of Korean Patent Application No. 10-2015-0072134, filed on May 22, 2015, in the Korean Intellectual Property Office, the entire content of which is herein incorporated by reference in its entirety.

TECHNICAL FIELD

Embodiments relate to a display device and in particular, to a gate driving device, a display device including the same and a method for driving the same.

DESCRIPTION OF THE RELATED ART

A display panel of a display device such as a liquid crystal display may include a gate line, a data line, a switching device electrically connected to the gate line and the data line and a pixel electrode electrically connected to the switching device.

In a display device, a gate signal applied to the gate line may transition from a gate-off voltage to a gate-on voltage, the switching device may be turned on in response to activation of the gate signal, and accordingly, a data signal applied to the data line may be charged to the pixel electrode.

The gate signal may transition from the gate-on voltage to the gate-off voltage, the switching device may be turned off in response to deactivation of the gate signal, and accordingly, the data signal may not be charged to the pixel electrode.

When the gate signal is deactivated, a kickback voltage may arise due to a parasitic capacitance of the switching device, deteriorating display qualities of the display device.

To reduce the kickback voltage, a kickback compensating section may be inserted which decreases the gate signal from the gate-on voltage to a kickback compensating voltage, which is higher than the gate-off voltage.

However, if the kickback compensating voltage is reduced and the kickback compensating section is increased, a charging rate of data in which the data signal is charged at the pixel electrode decreases, deteriorating display qualities of the display device.

SUMMARY

Embodiments relate to a gate driving device capable of improving image display qualities of a display device.

In another embodiment, a display device capable of improving image display quality is provided.

In yet another embodiment, a method for driving a display device capable of enhancing image display qualities is provided.

According to an exemplary embodiment, a gate driving device may include a reference voltage generator and a gate output voltage generator. The reference voltage generator may generate a kickback compensating reference voltage. The kickback compensating reference voltage may decrease during one frame section based on a horizontal synchronization signal. The gate output voltage generator may decrease a kickback compensating voltage of a gate output voltage during one frame section based on the kickback compensating reference voltage.

In an exemplary embodiment, the reference voltage generator may include a variable resistance circuit part and a voltage generator. Herein, a variable resistance circuit part may be referred to as a variable resistance circuit. The variable resistance circuit part may generate a FB voltage during a one frame section based on the horizontal synchronization signal. The variable resistance circuit part may change the variable resistance to decrease the FB voltage. The voltage generator may generate a kickback compensating reference voltage which decreases based on the FB voltage and during the one frame section.

In an exemplary embodiment, the gate output voltage generator may include a gate-on voltage generator, a switch and a load changing circuit. The gate-on voltage generator may generate a gate-on voltage which is a fixed voltage. The switch may output any one of the kickback compensating reference voltage or the gate-on voltage to an output terminal based on a kickback compensating signal. The load changing circuit may be coupled to the output terminal and adjust a voltage change slew rate of the output terminal by changing a current flowing to a load from the output terminal when the kickback compensating reference voltage is output.

In an exemplary embodiment, the load changing circuit may increase a voltage change slew rate of the output terminal during the one frame section by increasing a current that flows in a load by reducing the load during the one frame section.

According to an exemplary embodiment, a display device may include a plurality of pixels, a data driver, a gate driver, a voltage generator and a timing controller. Each of the pixels may be arranged at cross sections between a plurality gate lines and a plurality of data lines. The data driver may drive the plurality of data lines. The gate driver may drive the plurality of gate lines in response to a gate control signal. The voltage generator may supply a gate-on voltage and a gate-off voltage to the gate driver. The timing controller may control the data driver, the gate driver and the voltage generator in response to an image signal and a control signal input from an external device. The gate driver may increase a gate signal applied to the plurality of gate lines to a gate-on voltage in response to activation of a gate clock signal and decrease the gate signal from the gate-on voltage to a kickback compensating voltage based on a position of the gate line.

In an exemplary embodiment, the gate driver may change a reference voltage according to the position of the gate line. The reference voltage may be a reference for generating the kickback compensating voltage. The gate driver may change a slew rate by which the gate signal decreases from the gate-on voltage to the kickback compensating voltage according to the position of the gate line.

In an exemplary embodiment, the gate driver may include a reference voltage generator and a gate output voltage generator. The reference voltage generator may generate the reference voltage based on a gate initiation signal supplied from the timing controller. The gate output voltage generator may decrease the gate signal from the gate-on voltage to the kickback compensating voltage based on a gate initiation signal, a kickback compensating signal and the reference voltage supplied from the timing controller.

In an exemplary embodiment, the reference voltage generator may include a variable resistance circuit part and a voltage generator. The variable resistance circuit part may reduce a FB voltage by adjusting resistance based on the gate initiation signal. The voltage generator may generate a reference voltage based on the reduced FB voltage.

In an exemplary embodiment, the gate output voltage generator may include a gate-on voltage generator, a switch and a load changing circuit. The gate-on voltage generator may generate the gate-on voltage. The switch may selectively couple the gate-on voltage and the reference voltage to an output terminal based on the kickback compensating signal. The load changing circuit may be coupled to the output terminal and may change a voltage descending slew rate of an output terminal based on the gate initiation signal.

In an exemplary embodiment, the gate-on voltage may be a direct current voltage.

In an exemplary embodiment, if the switch couples the reference voltage to the output terminal, the load changing circuit coupled to the output terminal may receive a load current from the output terminal and increase a slew rate by which a voltage of the output terminal descends by reducing a load based on the gate initiation signal.

According to an exemplary embodiment, a method for driving a display device may be provided. The method may include changing a kickback compensating reference voltage according to a position of a horizontal line, changing a descending slew rate of a gate output voltage according to the position of the horizontal line and generating a gate output voltage based on the changed kickback compensating reference voltage and the descending slew rate.

In an exemplary embodiment, the changing of the kickback compensating reference voltage according to the position of the horizontal line may include reducing a FB voltage through a variable resistance corresponding to the position of the horizontal line based on a gate initiation signal and reducing a kickback compensating reference voltage corresponding to the position of the horizontal line based on the FB voltage.

In an exemplary embodiment, the changing of the descending slew rate of the gate output voltage according to the position of the horizontal line may increase a slew rate by which the gate output voltage changes by increasing a current flowing to a load by reducing a load coupled to a gate output terminal corresponding to the position of the horizontal line.

In an exemplary embodiment, the generating of the gate output voltage based on the changed kickback compensating reference voltage and the descending slew rate may decrease the gate output voltage from a gate-on voltage to the reduced kickback compensating reference voltage based on the increased slew rate.

In an exemplary embodiment, the generating of the gate output voltage based on the changed kickback compensating reference voltage and the descending slew rate may change a coupling terminal of the gate output terminal from an input terminal of the gate-on voltage to an input terminal of the kickback compensating reference voltage through a switch.

According to an exemplary embodiment, a method for driving a display device may be provided. The method for driving a display device may include receiving a kickback compensating reference voltage from a reference voltage generator, wherein the kickback compensating reference voltage decreases during a one frame section based on a horizontal synchronization signal. The method may further include receiving a kickback compensating voltage and the horizontal synchronization signal, and generating a gate output voltage by reducing the kickback compensating voltage based on the kickback compensating reference voltage during the one frame section.

In an exemplary embodiment, the method may include receiving a kickback compensating signal, and generating a gate-on voltage, wherein the gate-on voltage has a fixed voltage. The method may further include selecting one of the kickback compensating reference voltage and the gate-on voltage based on the kickback compensating signal as the gate output voltage, and adjusting the voltage slew rate of the gate output voltage by changing the load of a load changing circuit when the compensating reference voltage is selected.

In an exemplary embodiment, the method may include wherein adjusting the voltage slew rate of the gate output voltage by reducing the load of a load changing circuit increases the slew rate of the gate output voltage during the one frame section.

In an exemplary embodiment, the method may include generating an FB voltage by a variable resistance circuit part of the reference voltage generator and decreasing the FB voltage by altering the resistance of the variable resistance circuit part. The method may include generating the kickback compensating reference voltage by a voltage generator part of the reference voltage generator based on the FB voltage, during the one frame section, and transmitting the kickback compensating reference voltage.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
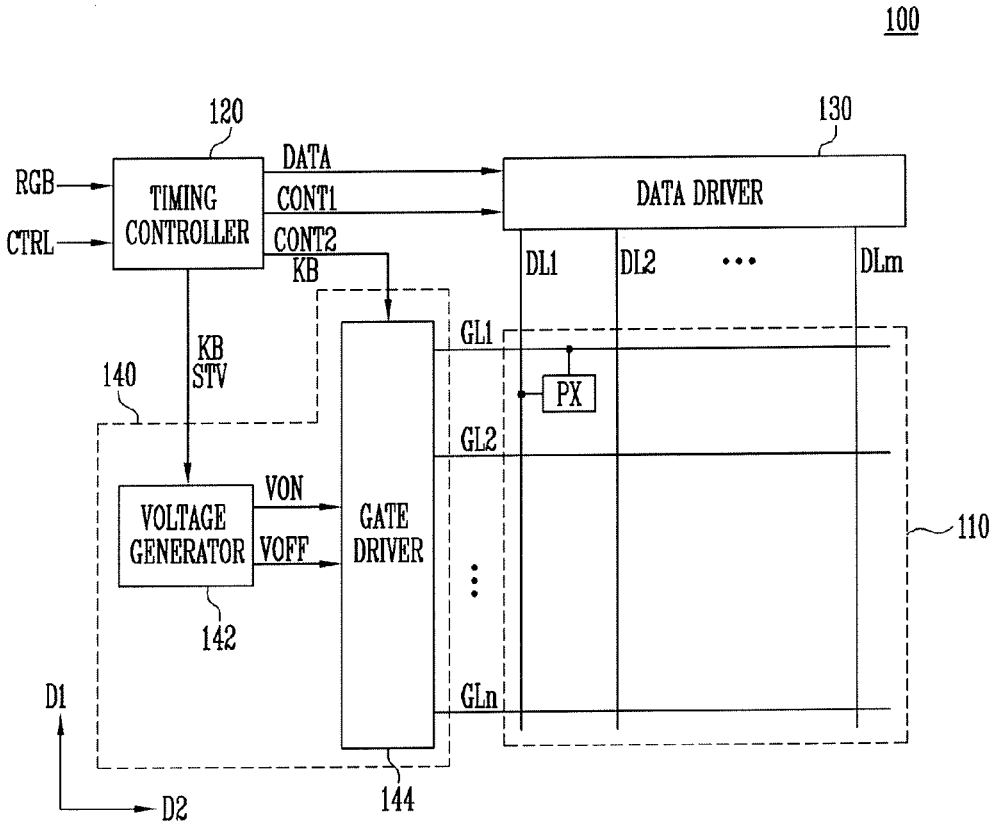
FIG. 1 is a block diagram of a display device in accordance with an embodiment.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, it will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section, a second element, component, region, layer or section could be termed a first element, component, region, layer or section, and so forth, without departing from the teachings of the present invention.

Spatially relative terms, such as "beneath", "below", "lower", "above", "upper" and the like, may be used herein for ease of description to describe one element or feature's relationship to another elements or features as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented rotated 90 degrees or at other orientations and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In a display device a parasitic capacitance may occur where there is a length of wire between two more components. The parasitic capacitance may change the slew rate of a signal and negatively change the operation of a display device by outputting a kickback voltage. For example, a parasitic capacitance may occur between a timing controller and a gate driving devices associated with each gate line. This parasitic capacitance may increase as the gate lines move further down the display and further away from the gate driver. This parasitic capacitance may reduce the slew rate of the descending edge of a clock signal and a gate output signal. Accordingly, the charge time for an affected pixel may be increased, which may result in a brighter pixel. Additionally, the output enable time for each pixel may be reduced, resulting in less time to fully discharge the charge built up from a cycle. This leftover charge may impact subsequent cycles.

In an exemplary embodiment, a negative kickback compensation voltage is applied to the gate clock signal to increase the slew rate of the descending edge of a clock signal. Accordingly, the charge time for an affected pixel is reduced, which may result in a more even pixel brightness. Additionally, the output enable time for each pixel may be increased, resulting in sufficient time to fully discharge.

FIG. 1 is a block diagram of a display device in accordance with an exemplary embodiment.

Referring to FIG. 1, a display device 100 may include a display panel 110, a timing controller 120, a data driver 130, and a gate driving device 140. The gate driving device 140 may include a voltage generator 142 and a gate driver 144.

The display panel 110 may include a plurality of data lines DL1 to DLm extending in a first direction D1 and a plurality of gate lines GL1 to GLn crossing the data lines DL1 to DLm and extending in a second direction D2, and a plurality of sub-pixels Px arranged in a matrix form at the crossing area.

Though not shown in the drawings, each sub-pixel Px may include a switching transistor coupled to corresponding data line and gate line, a crystal capacitor and a storage capacitor coupled to the switching transistor.

The timing controller 120 may receive, from an external device, control signals CTRL for controlling video signals RGB and their display, for example, vertical synchronization signals Vsync, horizontal synchronization signals Hsync, main clock signals MCLK, data enable signals DE, and the like. The timing controller 120 may supply data signals DATA and a first control signal CONT1 which processed the video signals RGB in accordance with operation conditions of the display panel 110 based on the control signals CTRL to the data driver 130, and a second control signal CONT2 to the gate driver 144. The first control signal CONT1 may include a horizontal synchronization initiation signal STH, a clock signal HCLK, and a line latch signal TP, and a second control signal CONT2 may include a gate initiation signal STV, a gate clock signal CPV, and an output enable signal OE.

The data driver 130 may output grayscale voltages for driving each of data lines DL1 to DLm in accordance with the data signal DATA and the first control signal CONT1 from the timing controller 120.

The voltage generator 142 may output a gate-on voltage VON and a gate-off voltage VOFF based on a kickback signal from the timing controller 120. The voltage generator 142 may further generate, not only the gate-on voltage VON and the gate-off voltage VOFF, but also a common voltage VCOM, and the like, which is needed for operation of the display panel 110. The gate-on voltage VON and the gate-off voltage VOFF may be applied to the gate driver 144.

The gate driver 144 may sequentially drive the gate lines GL1 to GLn in response to the gate-on voltage VON and the gate-off voltage VOFF from the voltage generator 142 and the second control signal CONT2 and the kickback signal KB from the timing controller 120. The gate driver 144 may include the gate driving integrated circuit (IC). The gate driving IC may be implemented with an amorphous silicon gate (ASG) circuit using an amorphous silicon thin film transistor a-Si TFT.

While the gate-on voltage VON is applied to a gate line, a row of switching transistors coupled thereto may be turned on, and at this point the data driver 130 may supply grayscale voltages corresponding to the data signals DATA to the data lines DL1 to DLm. The grayscale voltages supplied to the data lines DL1 to DLm may be applied to corresponding sub-pixel through turned on switching transistors. Switching transistors are turned on for a period of time. One period of a data enable signal DE and a gate clock signal CKV is referred to as "1 horizontal period" or "1 H."

The gate driver 144 of the display device 100 in accordance with an embodiment may increase the gate output voltage applied to the plurality of gate lines GL1 to GLn to the gate-on voltage VON in response to activation of a gate clock signal CPV, and decrease the gate signal to the kickback compensating voltage from the gate-on voltage VON based on the position of each of the gate lines GL1 to GLn.

In an embodiment, the gate driver 144 may change a reference voltage that serves as the standard by which the kickback compensating voltage is generated, in accordance with the position of the gate lines GL1 to GLn, and may change a slew rate at which the gate signal descends from the gate-on voltage VON to the kickback compensating voltage, in accordance with the position of the gate lines GL1 to GLn.

The gate workings of the display device in accordance with an embodiment have been explained. The operations as described above may be performed by the gate driving device 140 in accordance with an embodiment. The gate driving device 140 may include the gate driver, or may be implemented in a single body. In another embodiment, the driving device may be provided outside the gate driver. The gate driving device 140 will be described in more detail in accordance with an embodiment with reference to FIGS. 2 to 4.

Figure 2:
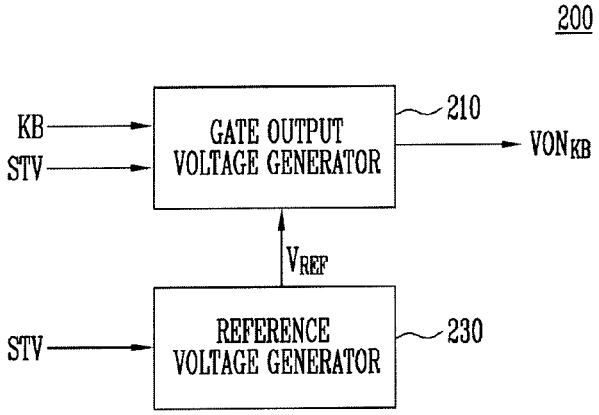
FIG. 2 is a block diagram of a gate driving device in accordance with an embodiment.

FIG. 2 is a block diagram of the gate driving device in accordance with an exemplary embodiment.

Referring to FIG. 2, a gate driving device 200 in accordance with an embodiment may include a reference voltage generator 230 and a gate output voltage generator 210.

The reference voltage generator 230, based on a gate initiation signal STV, may generate the kickback compensating reference voltage $V_{REF}$ which decreases during one frame section. For example, the reference voltage generator 230 may gradually decrease the kickback compensating reference voltage $V_{REF}$ which is output for the one frame section using a variable resistance. The kickback compensating reference voltage $V_{REF}$ may be a voltage which determines a difference in kickback compensating voltage for the kickback-compensated gate output voltage $VON_{KB}$.

The gate driving device may sequentially output the gate output voltage $VON_{KB}$ to each gate line in accordance with a latch signal TP. If the line hatch signal TP is activated, the gate output voltage $VON_{KB}$ applied to the corresponding gate line increases from the gate-off voltage VOFF to the gate-on voltage VON. The gate output voltage $VON_{KB}$, which has increased to the gate-on voltage VON, may decrease back to the gate-off voltage VOFF after a certain amount of time. To reduce the kickback compensating voltage, the gate output voltage $VON_{KB}$ may decrease to the kickback compensating voltage which is higher than the gate-off voltage VOFF before the gate output voltage $VON_{KB}$ decreases to the gate-off voltage VOFF. For example, the gate output voltage $VON_{KB}$ may decrease from the gate-on voltage VON first to the kickback compensating voltage, and then to the gate-off voltage VOFF.

The kickback compensating voltage may be generated based on the kickback compensating reference voltage $V_{REF}$. In an embodiment, the kickback compensating voltage may be the same as the kickback compensating reference voltage $V_{REF}$. In another embodiment, the kickback compensating voltage may be a value of which the kickback compensating reference voltage $V_{REF}$ is scaled as much as a certain rate. Explanations for cases where the kickback compensating voltage is the same as the kickback compensating reference voltage $V_{REF}$ are given below. An example will be given on the reference voltage generator 230 of the gate driving device 200 with reference to FIG. 3.

The gate output voltage generator 210, based on the kickback compensating reference voltage $V_{REF}$, may decrease the kickback compensating voltage of the gate output voltage $VON_{KB}$ during the one frame section. Therefore, the kickback compensating voltage corresponding to each gate line may be different for each gate line. For example, the gate output voltage generator 210 in accordance with an embodiment may set the kickback compensating voltage corresponding to the first gate line G1 the highest and gradually reduce the corresponding kickback compensating voltage as the position of the corresponding gate line changes from the first to the last. Therefore, the kickback compensating voltage for the last gate line GLn is set the lowest. Through this, when the display panel 110 shown in FIG. 1 is a large panel, deterioration in picture quality arising out of the differences in charging rates for the gate lines GL1 to GLn arising out of RC delay differences may be improved. The deterioration in picture quality due to charging rates of different gate lines GL1 to GLn with reference to FIGS. 5 and 6A to 6D will be explained below. Furthermore, an example of the gate output voltage generator 210 of the gate driving device 200 will be given with reference to FIG. 4.

Figure 3:
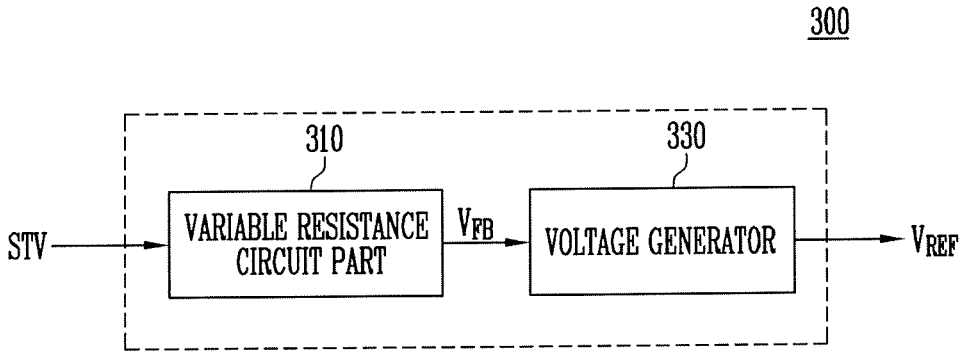
FIG. 3 is a block diagram of a reference voltage generator shown in FIG. 2 in accordance with an embodiment.

FIG. 3 is a block diagram of an exemplary embodiment of the reference voltage generator in FIG. 2.

Referring to FIG. 3, a reference voltage generator 300 may include a variable resistance circuit part 310 and a voltage generator 330. The variable resistance circuit part 310 may generate an FB voltage $V_{FB}$ which decreases through the variable resistance during one frame interval based on a gate initiation signal STV. The variable resistance circuit part 310, using voltage distribution, and for example, using variable resistance, may generate FB voltage $V_{FB}$ that decreases during the one frame section. When the gate initiation signal STV is activated, the variable resistance circuit part 310 may reset the output voltage to a certain voltage, and generate the continuously decreasing FB voltage $V_{FB}$ during the one frame section.

The voltage generator 330, based on the FB voltage $V_{FB}$, may generate a kickback compensating reference voltage $V_{REF}$ which decreases during the one frame section. The FB voltage $V_{FB}$ is the voltage which decreases during the one frame section, and the kickback compensating reference voltage $V_{REF}$ may be decreased in one frame section cycles in accordance with the FB voltage $V_{FB}$.

Figure 4:
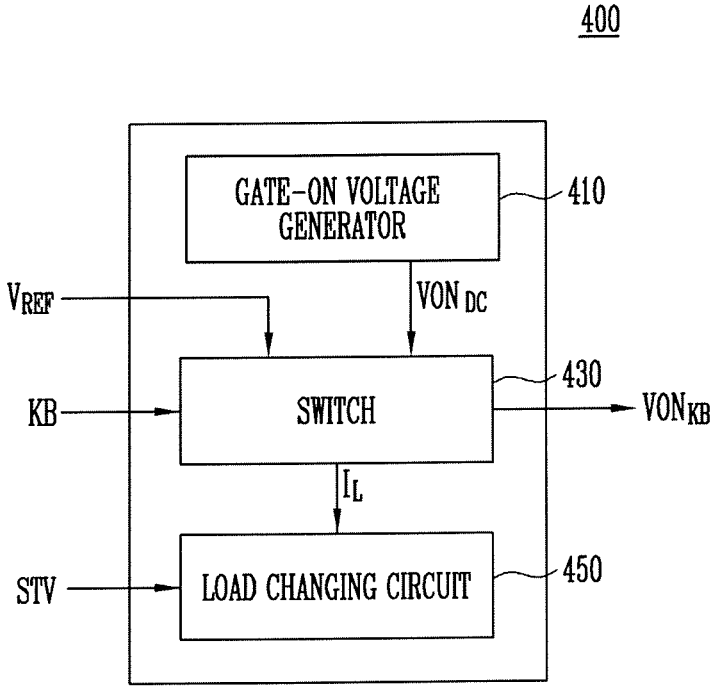
FIG. 4 is a block diagram of a gate output voltage generator shown in FIG. 2 in accordance with an embodiment.

FIG. 4 is a block diagram of an exemplary embodiment of a gate output voltage generator in FIG. 2.

With reference to FIG. 4, a gate output voltage generator 400 may include a gate-on voltage generator 410, a switch 430, and a load changing circuit 450. The gate-on voltage generator 410 may generate a gate-on voltage $VON_{DC}$, which is a fixed voltage. In accordance with an embodiment, the gate-on voltage generator 410 may be a power source that generates the gate-on voltage $VON_{DC}$, or a switching circuit connecting the gate-on voltage $VON_{DC}$ from an external source. Here, the gate-on voltage $VON_{DC}$ shown in FIG. 4 may be a gate-on voltage VON supplied from the voltage generator 142 shown in FIG. 1. The gate-on voltage generator 410 may output the gate-on voltage $VON_{DC}$, which is a direct current (DC) voltage, to the switch 430.

The switch 430, based on the kickback compensating signal KB, may output any one of the kickback compensating reference voltage $V_{REF}$ or the gate-on voltage $VON_{DC}$ to an output terminal. The output voltage may be a gate output voltage $VON_{KB}$. The gate output voltage $VON_{KB}$ is an output voltage to which kickback compensation is applied.

The load changing circuit 450 may be coupled to the output terminal which outputs the gate output voltage $VON_{KB}$. For example, a variable load and ground may be coupled inside the load changing circuit 450. As a result, a separate route from the output terminal may be formed. In this case, a load current IL may flow in a direction from the output terminal to the load changing circuit 450. If a voltage of the output terminal decreases, the slew rate at which the voltage decreases may change in accordance with a value of the load current IL. For example, if the load current IL is relatively small, since the rate of the voltage drop of the output terminal is relatively small, the slew rate may be relatively high. Inversely, if the load current IL is relatively large, since the rate of the voltage drop of the output terminal is relatively high, the slew rate may be relatively high. Thus, by adjusting the load inside the load changing circuit 450, the slew rate at which the gate output voltage $VON_{KB}$ decreases from the gate-on voltage $VON_{DC}$ to the kickback compensating reference voltage $V_{REF}$ may be adjusted.

The reason for changing the slew rate through the load changing circuit 450 is to be able to sufficiently decrease the gate output voltage $VON_{KB}$ in a short amount of time if the kickback compensating reference voltage $V_{REF}$ is relatively low. For example, when the voltage drop from the gate-on voltage $VON_{DC}$ to the kickback compensating reference voltage $V_{REF}$ is relatively higher. The voltage may not be sufficiently decreased in time when the gate output voltage $VON_{KB}$ decreases from the gate-on voltage $VON_{DC}$ to the kickback compensating reference voltage $V_{REF}$ without changing the slew rate. In this case, the charging rate may increase too much as subsequently described with reference to FIG. 6A or 6D. The gate driving device in accordance with an embodiment may decrease the kickback compensating reference voltage $V_{REF}$ or the kickback compensating voltage depending on the position of the gate line. By one or both of these methods the gate driving device changes the slew rate of the voltage drop through the load changing circuit coupled to the output terminal. Accordingly, the gate output voltage $VON_{KB}$ may be sufficiently decreased within the kickback compensating section limited with respect to a gate line with a large RC delay. Therefore, the difference in charging rate stemming from the difference resulting from RC delay in each line in a large panel can be minimized. Also, a problem with shortage of output enable signal section may be alleviated. These will be described below in further detail.

The load current IL may flow from the output terminal by the load changing circuit 450. The load changing circuit 450 may be coupled to the output terminal only when the output terminal is coupled to the kickback compensating reference voltage $V_{REF}$. For example, the switch 430 does not couple the load changing circuit 450 to the output terminal when the output terminal outputs the gate-on voltage $VON_{DC}$ which is generated by the gate-on voltage generator 410 to the gate output voltage $VON_{KB}$. Therefore, the gate-on voltage $VON_{DC}$ may be output, in its entirety, as the gate output voltage $VON_{KB}$ without any voltage drop. The switch 430 may couple the load changing circuit 450 to the output terminal if the output terminal outputs the kickback compensating reference voltage $V_{REF}$ as the gate output voltage $VON_{KB}$. Therefore, the gate output voltage VONKB may decrease to the kickback compensating reference voltage VREF or the kickback compensating voltage, and the descending slew rate may be controlled by the load changing circuit 450. Since the load changing circuit 450 gradually increases the slew rate during one frame section based on a vertical initiation signal STV, the slew rate which descends from the gate on-voltage $VON_{DC}$ to the kickback compensating reference voltage $V_{REF}$ or the kickback compensating voltage may be the smallest in the first gate line and the largest in the last gate line. Also, since the kickback compensating reference voltage $V_{REF}$ applied to the switch 430 gradually decreases during one frame section, the span of the voltage drop in which the gate output voltage $VON_{KB}$ decreases is the smallest in the first gate line and the largest in the last gate line in the kickback compensating section which is activated by the kickback compensating signal KB. The gate driving device in accordance with an embodiment may decrease the kickback compensating reference voltage VREF or the kick back compensating voltage according to a position of the gate line, and accordingly, the voltage drop slew rate may also be changed through the load changing circuit coupled to the output terminal. As a result, the gate output voltage VONKB may be sufficiently decreased in the limited kickback compensating section with respect to a gate line on which RC delay is great. Therefore, difference in charging rate due to RC delay per line in a large display panel can be minimized, and the problem which may arise as described below where the output enable signal section becomes short may be alleviated.

Figure 5:
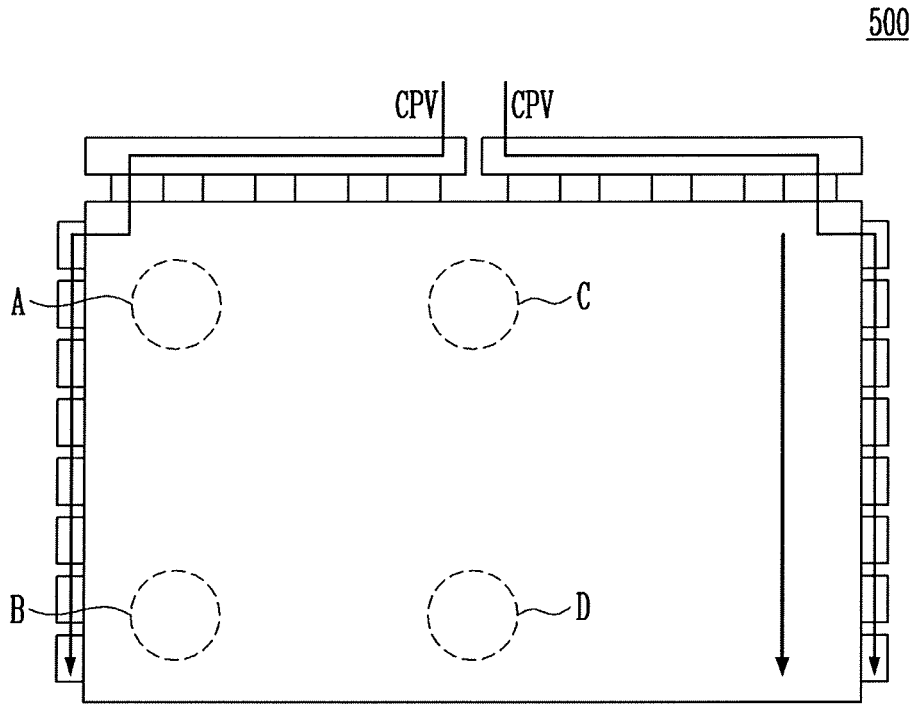
FIG. 5 illustrates a difference in a charging rate depending on a position of a gate line of a display panel.

FIG. 5 illustrates a difference in charging rate depending on a position of a gate line of a display panel according to an exemplary embodiment.

FIG. 5 schematically illustrates a structure of a display panel 500. As the display panel increases in size, the number of gate driver IC's also increases, and RC delay and signal delay due to panel wire and IC inner wire also increase. As a result, there may arise a problem in which the first gate line, an upper portion of the display panel 500 where a gate clock signal CPV is shown, is different from the last gate line which is a lower portion of the display panel 500. FIGS. 6A, 6B, 6C and 6D will show the problem stemming from delay of the gate clock signal CPV in areas A, B, C and D and the gate output signal in the conventional display panel. FIGS. 6A, 6B, 6C and 6D will also show the features of a gate clock signal CPV in areas A, B, C and D and the gate output signal in accordance with an embodiment.

FIGS. 6A to 6D are timing diagrams of gate clock signal and gate output voltage in areas A to D in FIG. 5 according to an exemplary embodiment.

Figure 6A:
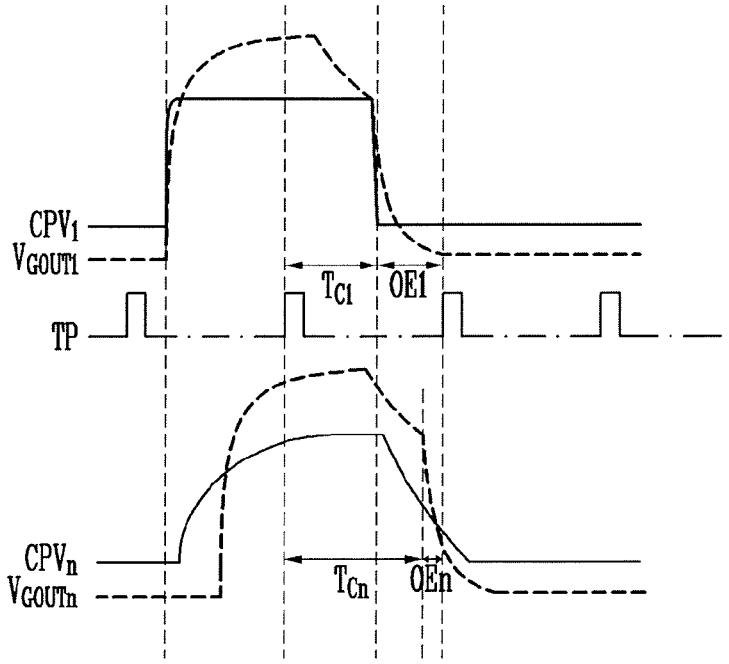
FIGS. 6A to 6D are timing diagrams of a gate clock signal and a gate output voltage in areas A to D in FIG. 5.

FIGS. 5 and 6A show a gate clock signal $CPV_1$ and a gate output signal $VGout_1$ in area A and a gate clock signal $CPV_n$ and a gate output signal $VG_{outn}$ in area B in the conventional display device, with a line latch signal TP as a reference.

As shown in FIG. 6A, a distance to area A, by which a signal is transferred, may be relatively short, and thus, delay of the gate clock signal $CPV_1$ and the gate output signal $VG_{out1}$ may be short. Accordingly, proper charging time $T_{c1}$ and output enable section OE1 may be sufficiently secured. On the other hand, in area B, where the gate clock signal $CPV_n$ may travel a greater distance than for area A, there may be a delay and distortion of a gate clock signal $CPV_n$. The greater distance to area B than area A may also result in a gate output signal $VG_{outn}$ and a charging time $T_{cn}$ being extended. Meanwhile, the output enable section OEn may be insufficient. Since the charging time $T_{cn}$ in area B is longer than the charging time $T_{c1}$ in area A, the display panel 500 may be brighter at its lower portion, e.g., the brightness increases as going further down the display panel 500.

Figure 6B:
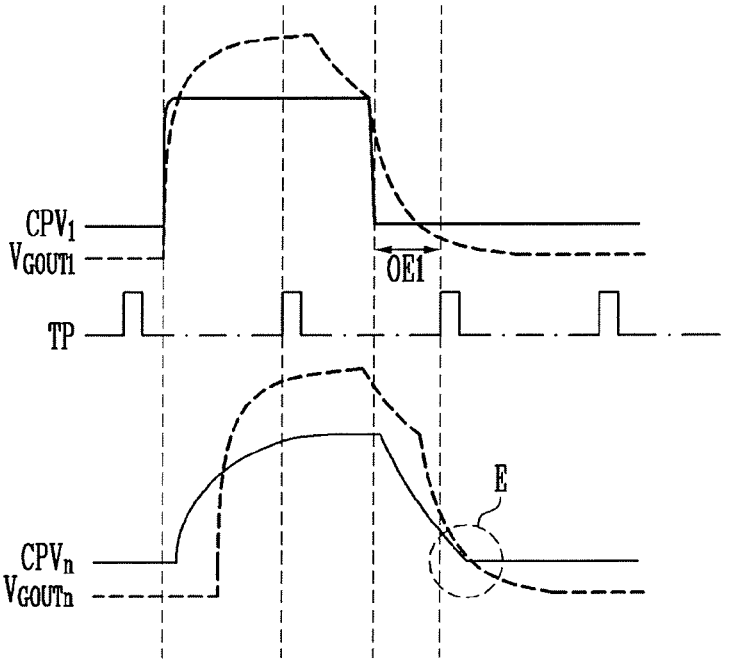

FIGS. 5 and 6B show a gate clock signal $CPV_1$ and a gate output signal $VGout_1$ in area C and a gate clock signal $CPV_n$ and a gate output signal $VG_{outn}$ in area D in the conventional display device, with a line latch signal TP as a reference. A difference between areas C and D and areas A and B is that areas C and D are relatively far away from a gate driving device or a gate driver.

As shown in FIG. 6B, a distance of area C, similar to area A, by which a signal is transferred, may be relatively short, and thus, delay of the gate clock signal $CPV_1$ and the gate output signal $VG_{out1}$ may be short. Accordingly, proper charging time $T_{c1}$ and output enable section OE1 may be sufficiently secured. On the other hand, in area D, similar to area B, as a distance, by which a signal is transferred, is extended relatively, there may be delay and distortion of a gate clock signal $CPV_n$ and a gate output signal $VG_{outn}$ and charging time $T_{cn}$ is extended. The output enable section OEn may also be lacking. In addition, in area D, since the output enable section may be short due to RC delay of the gate (referring to the description with respect to area E), the charge from one cycle may overlap subsequent data cycles. Also, as in the case of area B, since the charging time $T_{cn}$ in area D is longer than the charging time $T_{c1}$ in area C, the display panel 500 may be brighter at its lower portion, e.g., the brightness increases as going further down the display panel 500.

Referring to FIGS. 6A and 6B, the above-mentioned problems stemming from RC delay may occur because the gate output voltage does not rapidly decrease to the gate off voltage. In an exemplary embodiment, a long wire may be required to connect the gate driving device to the lower portion of the display panel, e.g. area B and D. The RC delay resulting from this configuration may be corrected by applying a kickback compensating voltage. The kickback compensating voltage changes the output slew rate resulting in a decreased charging rate and the output enable section being secured.

Figure 6C:
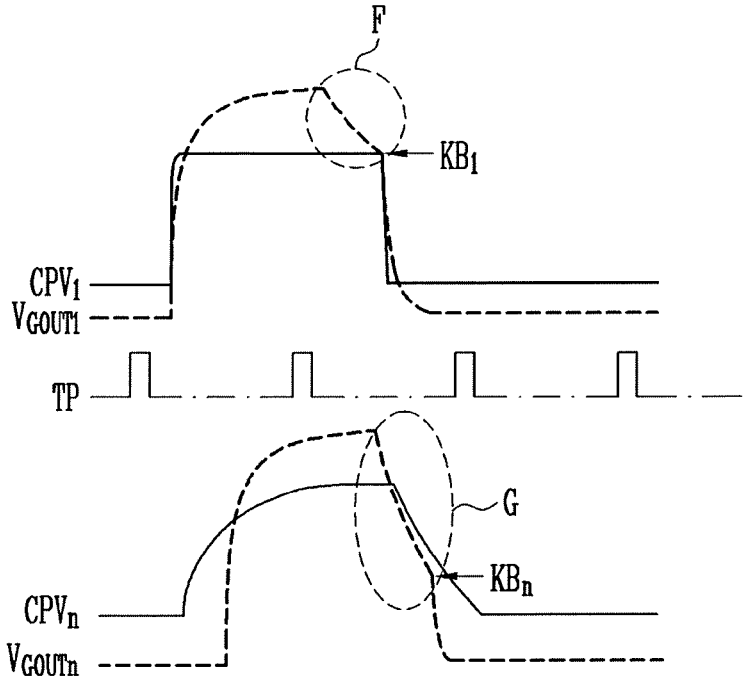

FIGS. 5 and 6C show a gate clock signal $CPV_1$ and a gate output signal $VG_{out1}$ in area A and a gate clock signal $CPV_n$ and a gate output signal $VG_{outn}$ in area B in accordance with an embodiment, with a line latch signal TP as a reference.

As shown in FIG. 6C, a distance from a gate driver to area A, by which a signal is transferred, may be relatively short, and thus, delay of the gate clock signal $CPV_1$ and the gate output signal $VG_{out1}$ may be short. Accordingly, charging time $T_{c1}$ and output enable section OE1 may be sufficiently secured. In an exemplary embodiment, the kickback compensating voltage is applied to area B. The kickback compensation voltage reduces the voltage of the gate output signal and increases the slew rate in area G when compared to the gate output signal corresponding to area A. The kickback compensating voltage may reduce the time to compensate for the kickback voltage and may reduce the difference in the charging rate between the gate output signal corresponding to area A and area B. Comparing area F and area G in FIG. 6C shows that a kickback compensating voltage $KB_n$ in area B is relatively smaller than a kickback compensating voltage $KB_1$ in area A. Also, a slew rate in the kickback compensating section in area A is bigger than a slew rate in the kickback compensating section in area B. In an exemplary embodiment, the difference in charging rate according to position of gate line in the display panel may be improved by adjusting the slew rate and the kickback compensating voltage in the kickback compensating section according to the position of gate line. Accordingly, irregular brightness in a display device may be ameliorated.

Figure 6D:
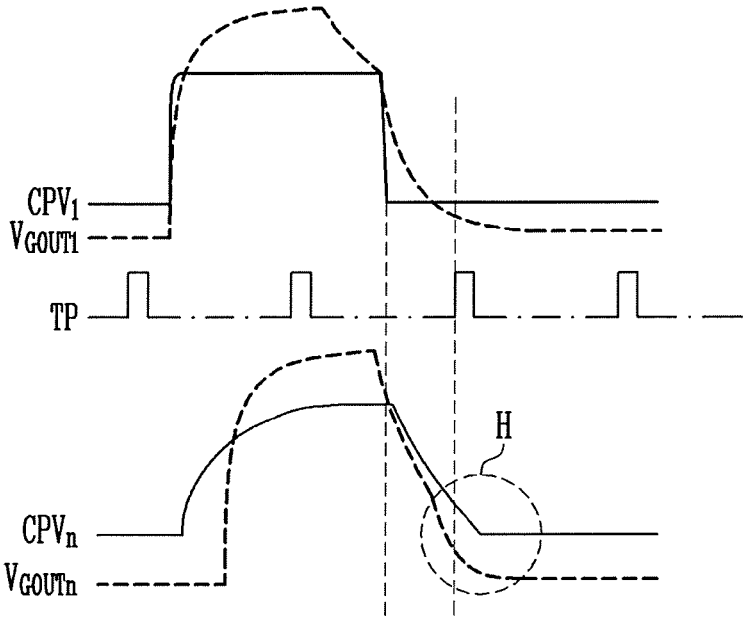

FIGS. 5 and 6D show a gate clock signal $CPV_1$ and a gate output signal $VG_{out1}$ in area C and a gate clock signal $CPV_n$ and a gate output signal $VG_{outn}$ in area D in accordance with an embodiment, with a line latch signal TP as a reference.

As shown in FIG. 6D, a distance from a gate driver to area C, by which a signal is transferred, may be relatively short, and thus, delay of the gate clock signal $CPV_1$ and the gate output signal $VG_{out1}$ may be short. Accordingly, charging time $T_{c1}$ and output enable section OE1 may be sufficiently secured. Also, in area D, by adjusting the kickback compensating voltage to be relatively lower than in the case of area C and the slew rate of voltage drop of the gate output signal to be relatively higher than in the case of area C (referring to area H), the difference in charging rate according to position of gate line may be improved and output enable section may be secured.

Figure 7:
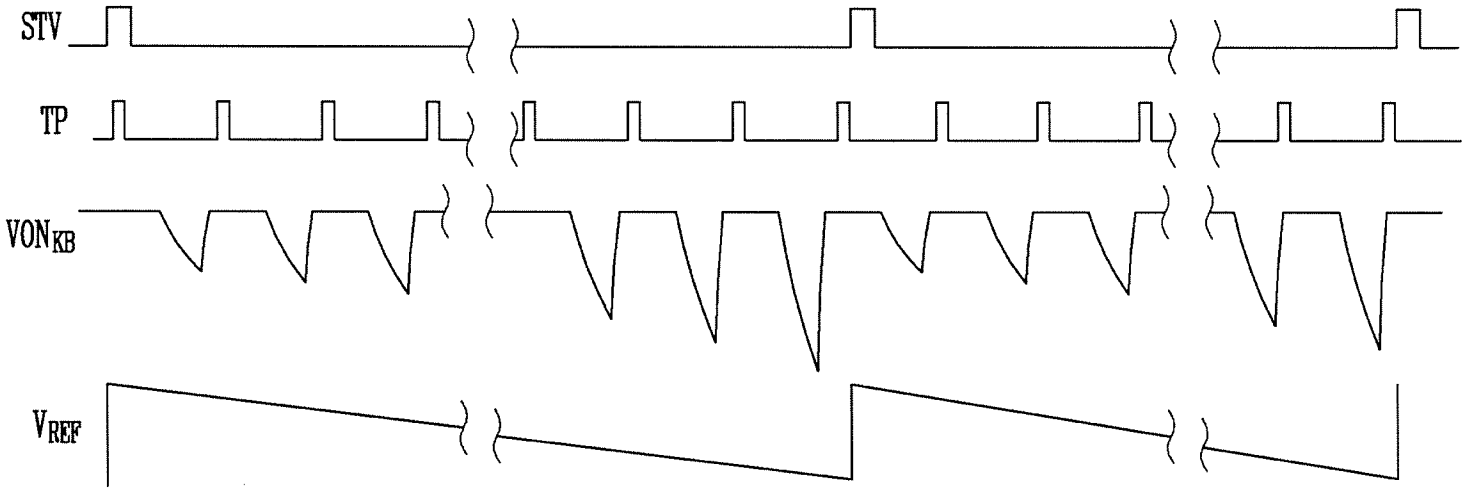
FIG. 7 is a waveform diagram of a gate output voltage and a reference voltage generated by a gate initiation signal, a line latch signal and a gate driving device.

FIG. 7 is a waveform diagram of a gate initiation signal, a line latch signal and a gate output voltage and a reference voltage generated by the gate driving device in accordance with an exemplary embodiment.

Referring to FIG. 7, if the gate initiation signal STV is activated, after the kickback compensating reference voltage $V_{REF}$ is reset, the voltage level gradually decreases during one frame section. As for the gate output voltage $VON_{KB}$, the voltage level may swing in accordance with a line latch signal TP. A lowermost voltage level of the swinging gate output voltage $VON_{KB}$ may gradually decrease during one frame section. Accordingly, different level s of kickback compensating voltage may apply according to the position of each gate line. Since the kickback compensating reference voltage $V_{REF}$ may decrease with respect to a first gate line, the voltage drop during the kickback compensating section of the gate output voltage $VON_{KB}$ may be relatively low. However, as the index number of the gate lines increase, the kickback compensating reference voltage $V_{REF}$ decreases. The voltage drop during the kickback compensating section of the gate output voltage $VON_{KB}$ also increases.

In an exemplary embodiment including a gate driving device or a display device including a gate driving device, the slew rate with respect to voltage drop of the gate output voltage $VON_{KB}$ may gradually increase during one frame section as the gate initiation signal STV is activated.

According to the waveform diagram shown in FIG. 7, it is shown that the kickback compensating reference voltage $V_{REF}$ decreases linearly during one frame section. However, in accordance with an embodiment, the kickback compensating reference voltage $V_{REF}$ may be implemented such that it decreases in discrete steps during one frame section.

In an exemplary embodiment, the gate output voltage $VON_{KB}$ includes a plurality of discrete peaks. The voltage of each peak of the gate output voltage $VON_{KB}$ is lower than the previous peak during a one frame section as indicated by the gate initiation signal STV. The voltage of each peak of the gate output voltage $VON_{KB}$ decreases linearly based on the kickback compensating reference voltage $V_{REF}$.

Figure 8:
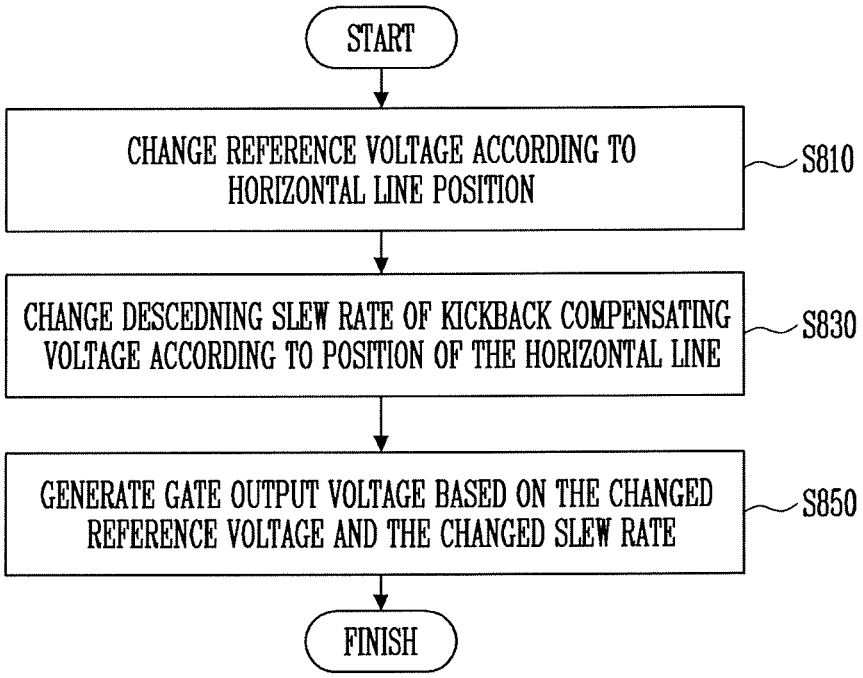
FIG. 8 is a flow chart of a method of driving a display device in accordance with an embodiment.

FIG. 8 is a flow chart of a method for driving a display device in accordance with an exemplary embodiment.

Referring to FIG. 8, a method for driving a display device in accordance with an embodiment may include changing a reference voltage according to a position of a horizontal line (S810), changing a slew rate by which a kickback compensating voltage decreases according to a position of a horizontal line (S830) and generating a gate output voltage based on the adjusted reference voltage and the adjusted slew rate (S850). Here, the horizontal line is the same as the gate line.

In the exemplary embodiment, the reference voltage is changed according to a position of a horizontal line (S810) by adjusting a variable resistance. The variable resistance may change according to a position of a corresponding gate line, and accordingly, the reference voltage may change. Referring to FIGS. 1 and 8, the reference voltage which corresponds to a first gate line GL1 may have a relatively high voltage level, and the reference voltage corresponding to a second gate line GL2 may have a lower value than the reference voltage corresponding to the first gate line GL1. The reference voltage corresponding to each gate line GL1 to GLn may decrease as from the first gate line GL1 to a last gate line GLn. Therefore, the reference voltage corresponding to a position of each gate line may change.

In the exemplary embodiment, the slew rate is changed by decreasing the kickback compensating voltage depending on the position of the horizontal line (S830). Additionally, the load coupled to the output terminal, which outputs the gate output voltage, may be adjusted, changing the load current flowing from the output terminal. In a method for driving a display device in accordance with an exemplary embodiment, by increasing the slew rate depending on the position of the horizontal line. As the horizontal lines go down a panel the speed at which the gate output voltage takes to arrive at the kickback compensating voltage, and secure the kickback compensating section, is decreased. For example, the kickback compensating voltage may decrease as it goes further down the display panel, but since the slew rate increases, the voltage drop of the gate output voltage, which increases, may be sufficiently maintained.

Figure 9:
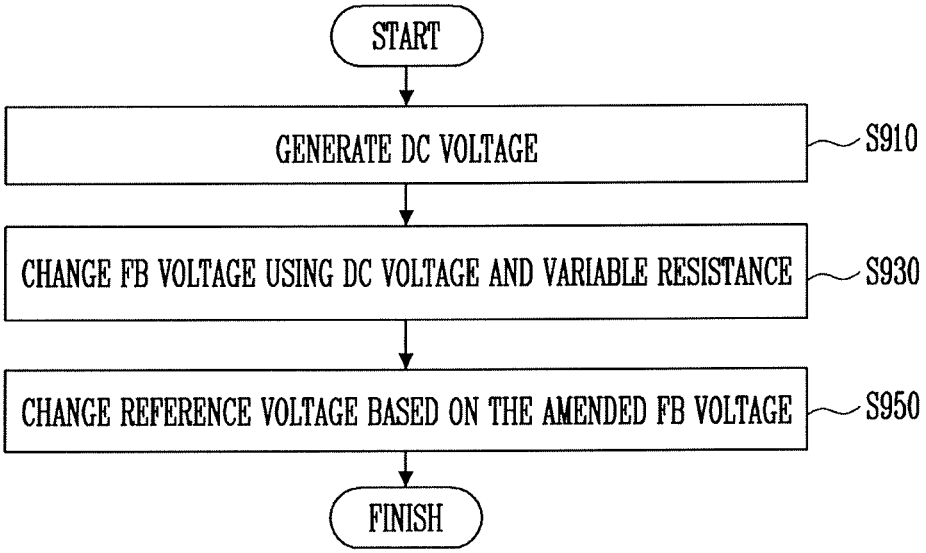
FIG. 9 is a flow chart of an example of a step of changing a reference voltage according to a position of a horizontal line in the method of FIG. 8.

FIG. 9 is a flow chart of an exemplary embodiment of changing a reference voltage according to a position of a horizontal line in the method shown in FIG. 8.

Referring to FIG. 9, the step of changing the reference voltage depending on the position of the horizontal line may include a step of generating a DC voltage (S910), changing an FB voltage using the DC voltage and a variable resistance (S930) and changing a reference voltage based on the changed FB voltage (S930). In the step (S910), the DC voltage may be generated first, and in the step (S930), the FB voltage may be changed by distributing voltage using, for example, a variable resistance. The FB voltage may decrease according to the position of the horizontal line. For example, as the position of the horizontal line is changed from the top to the bottom of the display panel, the FB voltage corresponding to the horizontal line which exists at a corresponding position may be reduced. A reference voltage which is reduced based on the FB voltage being reduced in the step (S930) may be generated in the step (S950).

Figure 10:
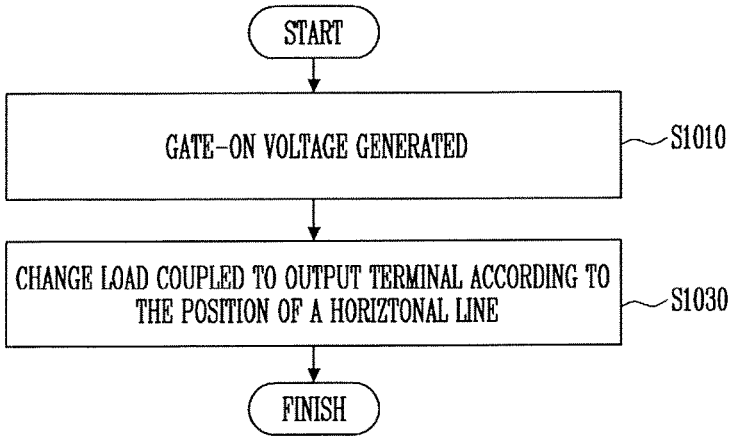
FIG. 10 is a flow chart of an example of a step of changing a descending slew rate of a kickback compensating voltage according to a position of a horizontal line in the method of FIG. 8.

FIG. 10 is a flow chart of an exemplary embodiment of steps for changing the voltage drop slew rate of a kickback compensating voltage in accordance with a position of a horizontal line in the method shown in FIG. 8.

Referring to FIG. 10, the step of changing the voltage drop slew rate of the kickback compensating voltage according to the position of the horizontal line may include a step of generating a gate-on voltage (S1010) and a step of changing a load coupled to an output terminal according to a position of a horizontal line (S1030). In the step of generating the gate-on voltage (S1010), as a gate clock signal CPV is activated, a gate output voltage may be increased to a gate-on voltage. In the step of changing the load coupled to the output terminal (S1030), in response to activation of the kickback compensating signal KB, the load coupled to the output terminal of the gate output terminal may be changed according to the position of the horizontal line. In the step (S1030), the load may gradually decrease according to the position of the horizontal line. For example, with respect to the horizontal line positioned on an upper portion of the display panel, a small slew rate may be maintained by coupling a relatively large load to the output terminal. The slew rate may be increased by decreasing the load coupled to the output terminal going further down the display panel. Consequentially, in the step (S1030), the load coupled to the output terminal may be reduced compared to the prior horizontal line. Accordingly, the slew rate of the output terminal may increase. The step (S1010) shown in FIG. 10 may be performed by the gate-on voltage generator 410 in FIG. 4 and the step (S1030) may be performed by the load changing portion 450 in FIG. 4.

Figure 11:
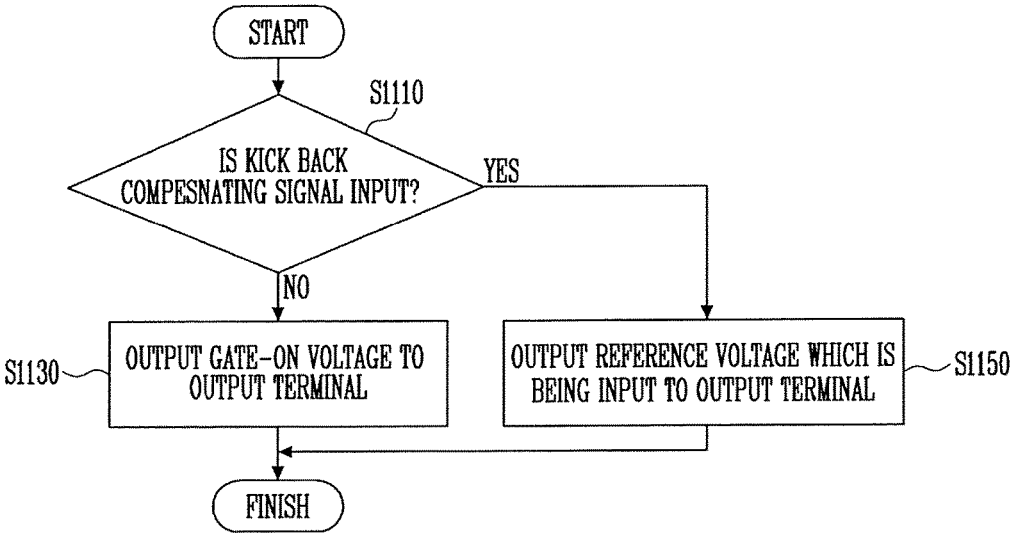
FIG. 11 is a flow chart of an example of a step of generating a gate output voltage based on the changed reference voltage and the changed slew rate in the method of FIG. 8.

FIG. 11 is a flow chart of an exemplary embodiment of steps for generating a gate output voltage based on the changed reference voltage and the changed slew rate in the method shown in FIG. 8.

Referring to FIG. 11, the step of generating a gate output voltage based on the adjusted reference voltage and the adjusted slew rate may include a step of determining whether the kickback compensating signal is input (S1110), a step of outputting a gate-on voltage input, if the kickback compensating signal is not the selected input, (S1130) and a step of outputting a reference voltage input, if the kickback compensating signal is input to an output terminal (S1150). In an embodiment, the steps in FIG. 11 may be performed by a switch 430 shown in FIG. 4.

Here, each block of the process flow chart diagrams and combinations of the flow chart diagrams may be performed by computer program instructions. Since these computer program instructions may be planted in general purpose computer, special purpose computer, or processors of programmable data processing equipment, the instructions that are performed through computer or processor of programmable data processing equipment may create means to perform the functions described in the flow chart blocks. To implement function in certain ways, it may be possible that these computer program instructions use computer or computer supporting programmable data processing equipment or are stored in computer readable memory. As a result, it may be possible that the instructions that use a computer or that are stored in computer readable memory manufacture goods containing instruction means that perform the functions described in the flow chart diagrams.

In addition, each block may represent a portion of a module, segment or code including at least one executable instruction to perform certain logical function(s). Also, in other alternate examples, it may be possible that the functions described in the blocks can be performed out of sequence. For example, two blocks that are shown as immediately next to each other may be performed simultaneously or even in inverse order depending on the corresponding function.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A gate driving device comprising:

a reference voltage generator configured to generate a kickback compensating reference voltage, wherein the kickback compensating reference voltage decreases during one frame section based on a gate initiation signal; and a gate output voltage generator configured to decrease a kickback compensating voltage of a gate output voltage based on the kickback compensating reference voltage during the one frame section, wherein the gate output voltage generator comprises:

a gate-on voltage generator configured to generate a gate-on voltage, the gate-on voltage being a fixed voltage;

a switch configured to output one of the kickback compensating reference voltage or the gate-on voltage to an output terminal based on a kickback compensating signal; and a load changing circuit coupled to the output terminal and configured to adjust a voltage change slew rate of the output terminal by changing a current flowing to a load from the output terminal when the kickback compensating reference voltage is output.

2. The gate driving device as claimed in claim 1, wherein the reference voltage generator comprises:

a variable resistance circuit part configured to generate a feedback (FB) voltage, wherein the variable resistance circuit part changes the variable resistance to decrease the FB voltage during the one frame section based on the gate initiation signal; and a voltage generator configured to generate the kickback compensating reference voltage, wherein the kickback compensating reference voltage decreases during the one frame section.

3. The gate driving device as claimed in claim 1, wherein the load changing circuit increases a voltage change slew rate of the output terminal during the one frame section by increasing a current that is sunk by reducing a load during the one frame section.

4. A display device comprising:

a plurality of pixels, each positioned at cross sections between a gate line of a plurality of gate lines and a data line of a plurality of data lines;

a data driver configured to drive the plurality of data lines;

a gate driver configured to drive the plurality of gate lines in response to a gate control signal;

a voltage generator configured to supply a gate-on voltage and a gate-off voltage to the gate driver; and a timing controller configured to control the data driver, the gate driver and the voltage generator in response to an image signal and a control signal input from an external device, wherein the gate driver increases a gate signal applied to the plurality of gate lines to a gate-on voltage in response to activation of a gate clock signal and decreases the gate signal from the gate-on voltage to a kickback compensating voltage based on a position of the gate line, wherein the gate driver changes a reference voltage according to the position of the gate line, the reference voltage being a reference for generating the kickback compensating voltage, and changes a slew rate by which the gate signal decreases from the gate-on voltage to the kickback compensating voltage according to the position of the gate line.

5. The display device as claimed in claim 4, wherein the gate driver comprises:

a reference voltage generator configured to generate the reference voltage based on the gate initiation signal supplied from the timing controller; and a gate output voltage generator configured to decrease the gate signal from the gate-on voltage to the kickback compensating voltage based on the gate initiation signal, wherein a kickback compensating signal and the reference voltage are supplied from the timing controller.

6. The display device as claimed in claim 5, wherein the reference voltage generator comprises:

a variable resistance circuit part configured to reduce a feedback (FB) voltage by adjusting resistance based on the gate initiation signal; and a voltage generator configured to generate a reference voltage based on the reduced FB voltage.

7. The display device, as claimed in claim 5, wherein the gate output voltage generator comprises:

a gate-on voltage generator configured to generate the gate-on voltage;

a switch configured to selectively couple the gate-on voltage and the reference voltage to an output terminal based on the kickback compensating signal; and a load changing circuit coupled to the output terminal and configured to change a voltage descending slew rate of an output terminal based on the gate initiation signal.

8. The display device as claimed in claim 7 wherein the gate-on voltage is a direct current voltage.

9. The display device as claimed in claim 7, wherein when the switch couples the reference voltage to the output terminal, the load changing circuit coupled to the output terminal receives a load current from the output terminal and increases a slew rate by which a voltage of the output terminal descends by reducing a load based on the gate initiation signal.

10. A method for driving a display device, the method comprising:

changing a kickback compensating reference voltage according to a position of a horizontal line;

changing a descending slew rate of a gate output voltage according to the position of the horizontal line; and generating a gate output voltage based on the changed kickback compensating reference voltage and the descending slew rate, wherein the changing of the descending slew rte of the gate output voltage according to the position of the horizontal line increases a current flowing to a load by reducing a load coupled to a gate output terminal corresponding to the position of the horizontal line, such that the slew rate by which the gate output voltage changes is increased corresponding to the increased current flowing.

11. The method, as claimed in claim 10, wherein the changing of the kickback compensating reference voltage according to the position of the horizontal line comprises:

reducing a feedback (FB) voltage through a variable resistance corresponding to the position of the horizontal line based on a gate initiation signal; and reducing the kickback compensating reference voltage corresponding to the position of the horizontal line based on the FB voltage.

12. The method as claimed in claim 11, wherein the generating of the gate output voltage based on the changed kickback compensating reference voltage and the descending slew rate decreases the gate output voltage from a gate-on voltage to the reduced kickback compensating reference voltage based on the increased slew rate.

13. The method as claimed in claim 10, wherein the generating of the gate output voltage based on the changed kickback compensating reference voltage and the descending slew rate changes a coupling terminal of the gate output terminal from an input terminal of the gate-on voltage to an input terminal of the kickback compensating reference voltage through a switch.

14. A method for driving a display device comprising:

receiving a kickback compensating reference voltage from a reference voltage generator, wherein the kickback compensating reference voltage decreases during one frame section based on a gate initiation signal;

receiving a kickback compensating voltage and the gate initiation signal; and generating a gate output voltage by reducing the kickback compensating voltage based on the kickback compensating reference voltage during the one frame section receiving a kickback compensating signal;

generating a gate-on voltage;

wherein the gate-on voltage has a fixed voltage;

selectin one of the kickback compensating reference voltage and the gate-on voltage based on the kickback compensating signal as the gate output voltage; and adjusting the voltage slew rate of the gate output voltage by changing the load of a load changing circuit when the compensating reference voltage is selected.

15. The method as claimed in claim 14, wherein adjusting the voltage slew rate of the gate output voltage by reducing the load of a load changing circuit increases the slew rate of the gate output voltage during the one frame section.

16. The method as claimed in claim 14, further comprising:

generating a feedback (FB) voltage by a variable resistance circuit part of the reference voltage generator and decreasing the FB voltage by altering the resistance of the variable resistance circuit part;

generating the kickback compensating reference voltage by a voltage generator part of the reference voltage generator based on the FB voltage, during the one frame section; and outputting the kickback compensating reference voltage.

* * * * *